US007052391B1

(12) United States Patent
Luciano, Jr.

(10) Patent No.: US 7,052,391 B1
(45) Date of Patent: May 30, 2006

(54) TARGET-BASED WAGERING SYSTEM AND METHOD

(75) Inventor: Robert Anthony Luciano, Jr., Reno, NV (US)

(73) Assignee: Edge Technology, Reno, NV (US)

( * ) Notice: Subject to any disclaimer, the term of this patent is extended or adjusted under 35 U.S.C. 154(b) by 121 days.

(21) Appl. No.: 10/087,378

(22) Filed: Mar. 1, 2002

Related U.S. Application Data

(63) Continuation-in-part of application No. 10/057,007, filed on Jan. 24, 2002.

(60) Provisional application No. 60/264,609, filed on Jan. 26, 2001, provisional application No. 60/273,476, filed on Mar. 2, 2001.

(51) Int. Cl.
*A63F 9/24* (2006.01)

(52) U.S. Cl. ..... 463/3; 463/28

(58) Field of Classification Search ..... 473/53, 473/134, 174, 192, 351, 353; 273/317.2, 273/348, 108.2, 108.3, 108.4; 463/1, 3, 42
See application file for complete search history.

(56) References Cited

U.S. PATENT DOCUMENTS

| | | | | |
|---|---|---|---|---|
| 3,828,353 | A * | 8/1974 | Majikrzak et al. | 343/873 |
| 5,102,140 | A * | 4/1992 | Vincent | 473/156 |
| 5,439,224 | A * | 8/1995 | Bertoncino | 473/153 |
| 5,505,457 | A * | 4/1996 | Boylan et al. | 273/274 |
| 5,513,841 | A * | 5/1996 | Takagi | 473/134 |
| 5,743,815 | A * | 4/1998 | Helderman | 473/353 |
| 5,949,679 | A * | 9/1999 | Born et al. | 463/42 |
| 6,569,028 | B1 * | 5/2003 | Nichols et al. | 473/192 |
| 6,607,123 | B1 * | 8/2003 | Jollifee et al. | 235/375 |

* cited by examiner

*Primary Examiner*—Xuan M. Thai
*Assistant Examiner*—Robert Mosser
(74) *Attorney, Agent, or Firm*—Michael A. Kerr; Virtual Legal, P.C.

(57) ABSTRACT

A new and useful ball range system for wagering is disclosed. The system incorporates targets having RFID readers therein, coupled with at least one server communicating with each target, and further having the potential to operate over more than one physical site. The wagering supported is characterized by player-funded winnings, of which pari-mutuel betting on ball-based games is one example. The system enables operators to offer many wagering games based on a games outcome in an efficient and exciting manner to a player using player-funded pools.

28 Claims, 5 Drawing Sheets

Ball Range System

Top View Of A Range Target With 4 Receivers

Perspective View
Of Range Target
With Single Receiver

Method Of Using
Golf Range Target System

Pari-Mutuel Betting Using Golf Range Target System

TARGET-BASED WAGERING SYSTEM AND METHOD

RELATED APPLICATIONS

This application is a continuation-in-part of application Ser. No. 10/057,007 filed on 24 Jan. 2002 entitled "Enhanced Golf Range Play Using RFID and GPS", which claims the benefit of the filing date of provisional application 60/264,609 filed on Jan. 26, 2001, entitled "Enhanced RFID-Based Golf Range Play and Management", the aforementioned applications incorporated in full herein by explicit reference; this application further claims the benefit of the filing date of provisional application 60/273,476 filed on Mar. 2, 2001, entitled "Target-based Wagering System And Method", incorporated in full herein by explicit reference.

BACKGROUND OF THE INVENTION

1. Field of the Invention

This invention pertains generally to practice ranges where the participant plays by hitting, throwing, or kicking a ball. More particularly, the present invention discloses a method and apparatus for providing users of a range having targets with an automated betting system.

2. The Prior Art

In this disclosure, the concept of "range" is used in the general sense to mean a practice area for a ball-based game, such as golf putting or hitting, baseball pitching and hitting, soccer ball kicking, and football throwing and kicking. Ranges, in general, have typical configurations for each type of ball-based game. Two common ranges found in the US are golf ranges and baseball ranges; the baseball ranges may be further divided into throwing (pitching) ranges and hitting cages.

Golf ranges have typical configurations, well-known to those that use them. There is an entry point, where the player purchases some quantity of balls from the range. There may be minor variances in the pay schedule (regular players, walk-ons, etc.) but buying the balls is the player's payment for using the range. The golf balls are typical stored in baskets or in a large hopper which dispenses a number of balls on demand (similarly to a coin dispenser) into a basket. There is no individually assignable ID on a per golf ball basis. The player then takes the balls to the tee or matt area, and hits them out into the range (or putting green) until they are gone.

Baseball throwing and hitting areas are similar—a player buys a certain number of balls for throwing, or buys a certain amount of time for hitting, and uses the balls or the time until done. The "scoring" is either non-existent or manual, and if manual is done by the player. Similar situations are found for the less common ranges such as those using a football or a soccer ball; the player buys either time or a number of balls, and the scoring (if any) is manual, carried out by the player.

Returning to golf ranges, a typical driving range will have various markers for distance placed throughout the range. A player hits a ball, and follows it with their eyes (if they can). After the ball hits the ground, a player must do as best they can to make a visual estimate of the distance they hit the ball, using the nearest distance marker. That completes the play.

There is some variation to the standard golf ranges found in England. There, several installations have added permanent targets in parts of the range. These targets are designed similarly to skee-ball type targets found in arcade games. The target is a set of two or more concentric rings, with drainage holes for balls that enter a ring (the drainage holes are similar to the those found in the last hole of a miniature golf course, where the ball follows a drain permanently installed underground back to the register or cashier booth). The targets are typically made of cement with a fabric covering. In some installations, the golf balls have RFID tags in them, and the balls entering the drain in the concentric circles of the target are read as they roll through the drain pipe. This allows the range to keep "scores" as golfers hit balls into the rings. Another fixed detector-style system is disclosed in U.S. Pat. No. 5,743,815 to Helderman. Helderman discloses a golf driving range having a plurality of RFID sensors at fixed, permanent locations, including along a back wall which a golfer may hit if the golfer hits a ball far enough. Both Helderman and the ranges found in the UK use only RFID readers (sensors) in fixed locations, permanently installed on or under the range.

The current range play options for golfers is quite limited. In addition, there is no regular, reliable means for placing bets on games between players using targets on the range.

The current range of play available for baseball, football, soccer, and other ball-based games is even more limited than for golf range users. All have virtually no automated scoring, and none have any way of making wagering or winning games available to a player other than the simple "one-shot" type of game (i.e., a hole-in-one for golf, a single basket from a single location thrown one at a time for basketball, etc.). Even for those types of games, the entire range is typically devoted to that one game whilst it is being played (making it unavailable for players who do not want to wager). This is due to the fact that the logistics associated with manually watching over the game is too high to do anything but play a simple (one-shot style) wagering game, or have the range open to non-wagering play.

BRIEF DESCRIPTION OF THE INVENTION

The present invention overcomes the significant limitations of the prior art by providing a system and method that enables ranges to offer not just one simple wagering game (i.e., the one-shot games), but a plurality of games of varying complexity, involving multiple targets and multiple game play options, all run simultaneously. In addition, the range is fully open to non-wagering players at the same time. This flexibility provides new avenues of revenue for the operators, and greatly increase player interest and excitement. Even if a player is not themselves wagering, they can participate in the general excitement when a player who is wagering wins. Further, the flexibility of the present invention allows operators to set up games that appeal to both "high rollers", people who can afford to make large wagers, as well as regulars who are more likely to participate in games more frequently, but in smaller-stakes games.

The system that supports the method involves having the balls being used for wagering have RFID tags therein. Note that players using a range for non-wagering practice may use non-RFID balls—there is no problem mixing the two in the present invention. Non-RFID balls will pass through the readers with either no affect (no data being sent out from the reader if no RFID is detected), or the readers may report to the local server that a ball has passed through that had no RFID (for tallying purpose, perhaps).

The system comprises RFID readers in targets on the range. These RFID readers are in communication with a local server; if the system is designed to encompass multiple sites (as is expected in many installations), local servers will be in operable communication with a central server, typically using WAN connectivity. The local and central server will have databases on the them; examples for a local server may be Microsoft® Access® running on Microsoft® NT®; for larger servers it is expected that a database like Oracle® will be used. The databases are used to associate sets of balls (using their RFIDs) with a player ID, an anonymous player ID, or as a set simply using the ball IDs themselves. The set is created by running the balls through a reader when the player buys the balls for use on the range. In a game situation, it is expected that the most normal usage will be for a set number of balls (i.e., 10 golf balls), which are then taken on to the range by the player. The player then tries to hit the designated targets with this set of 10 balls for a win. A player may then purchase a second set of 10 balls and continue play.

Note that some games are particularity amendable to a time based cost structure as well as a number of balls cost structure. An example would be a baseball hitting range. An RFID can read each baseball just before the pitching machine throws it to the player. The player can either slow the machine down, or speed it up. They rent the machine for ½ hour (for example), and may hit as many or as few balls as they wish. Each ball can be tracked using its RFID, if it hits a target on the range. A wagering game could consist of hitting a designated set of targets (i.e., three) at least twice each during the allotted time. Other game variations will readily come to mind of having ordinary skill in the art when such a person has the advantage of the present disclosure.

Overall, the system of the present invention uses at least two RFID readers. One is at the backend, which is defined to mean balls' RFIDs are read any time or place before the ball is put into play by the player. One is at the front end, which is defined to mean ball's RFIDs are read by an RFID reader in a manner associated with a target on the range.

The RFID data (including but not limited to time and date stamps, target data if applicable, as well as the RFID itself) is associated into a group using a database on a local server, a central server, or both. The association may be made using a plyer ID, an anonymous player ID, or simply using the ball RFIDs themselves. Once the association is made, the balls are used by a player in a manner consistent with the game and type of ball being played. Balls hitting/entering a target have that data sent to a local server and entered into a database.

There is a program on either the local server, central server, or both (each installation will decide where it wants specific calculations to be made) that uses the data in the database to check ball groups for ending events and/or winning events (i.e., one group of 10 balls all entering/hitting a designated target on the range). Ending events are expected to be used to purge the database of spurious data—that is, after is has been established that a particular group of 10 golf balls have not hit any winning combination of targets, there is no longer any need to keep the group as a "live" entity in the system. The occurrence of the non-win will typically be logged for accounting purposes (along with supporting data showing the non-win result), but there will be no need to use database resources for a static record; or, it can be downloaded to a backend system for long term records keeping. These logistics can readily be determined by the needs for each specific implementation.

The program, if it detects a winning event, will then keep that information until a payout is made. Payouts will be determined by the type of game play and the type of wagering being used, although all wagering (for this disclosure) have the common property of using a player-funded pool for the payouts.

DETAILED DESCRIPTION OF PREFERRED EMBODIMENTS

Figure 1:
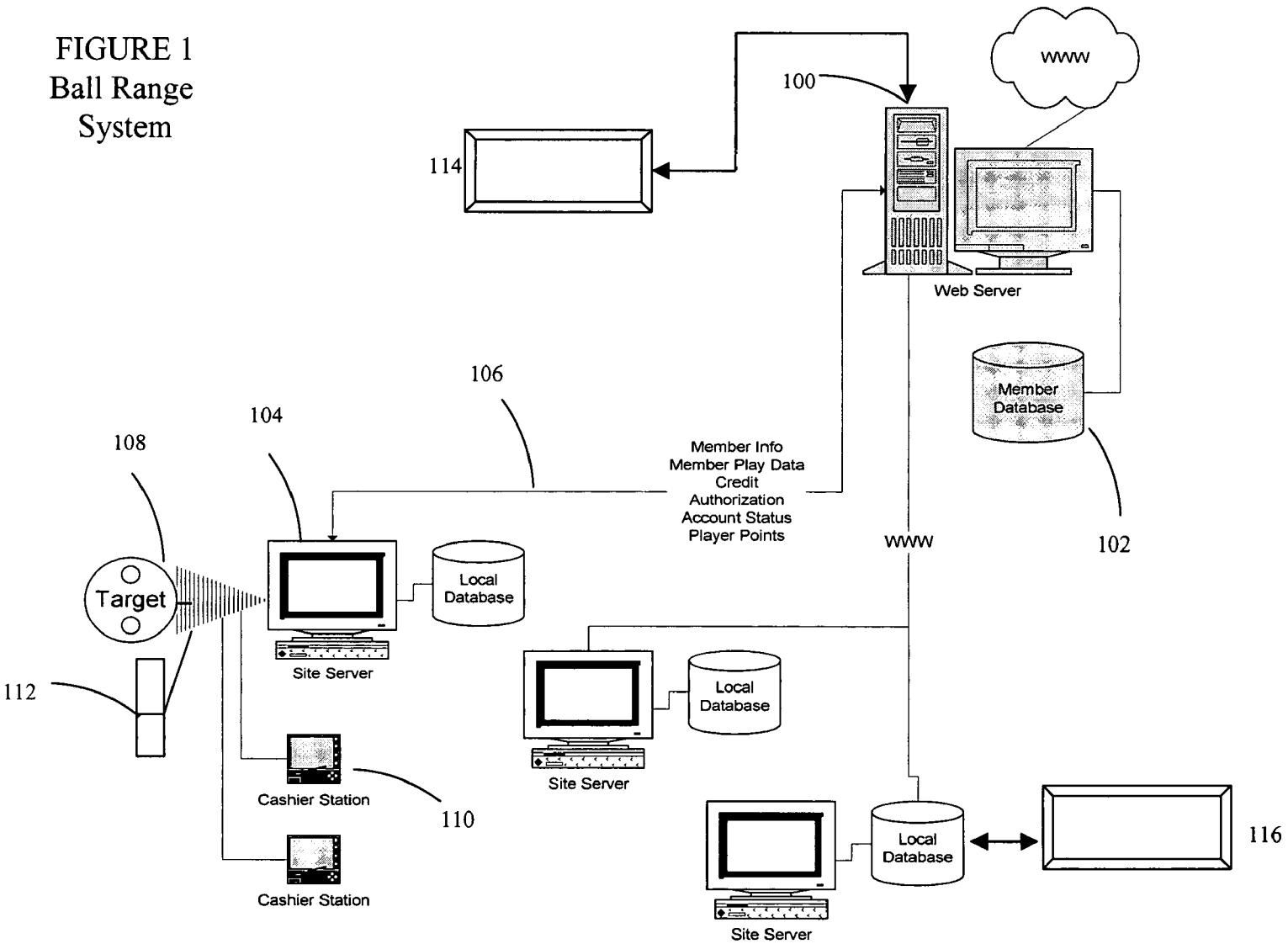
FIG. 1 is a block diagram of one ball range system according to the present invention.

The description of the invention found in the present disclosure is illustrative of several embodiments, but is not limited to them. Other embodiments of the invention will be apparent to person having ordinary skill in the art and having the benefit of this disclosure.

Referring to the drawings, for illustrative purposes the present invention is shown embodied in FIGS. 1 through 5. It will be appreciated that the apparatus may vary as to configuration and as to details of the parts without departing from the inventive concepts disclosed herein. The method may vary as to details, partitioning, repetition, inclusion or exclusion of some of the described acts, and the order of the acts, without departing from the inventive concepts disclosed herein.

FIG. 1 shows a golf range system in accordance with the present invention. A player making use of the system will either provides their own balls having RFID tags therein, or more commonly will purchase balls to use on the range, those balls having RFID tags therein.

If the balls are owned by the player, there are two ways to enter them into the system. The first is to create a player account, intended to kept permanently on the range's database of players. The player will typically be issued a player's card, often in the form of a magnetic stripe card but including any type of readable media from which a player's ID may be read. Alternatively, the player may be issued a player ID in the form of a PIN. After creating the account, the player puts their balls in a ball RFID reader, and the ID of each ball is read, then that number is entered in a database having records with fields associated with the player for ball IDs. Depending on the size of the range, the database may be implemented in a smaller package such as Microsoft's® Access® running on Windows® or NT®, or for larger ranges an Oracle® database. Whatever database is chosen, the ball IDs are associated with the player ID. The second method does not require a player ID; the balls are simply read by a reader and grouped by assigning an anonymous player ID, or grouped by allowing a ball ID to be used as a lookup into a set of balls defined as a group. The player now enters the tee area of the range.

If a player purchases the balls at the range, there will typically be a large ball hopper containing many golf balls, buckets of balls already dispensed, or for specific games there may be a specific small number of balls dispensed (i.e., 6 balls). In any case, the balls to be used for practice or games (including betting games) will then be passed through a reader which will associate the ball ID numbers with either an existing player account, or a temporary (anonymous) player account. If the account is temporary, the player may be issued a paper voucher with a temporary ID on it, preferably having both machine readable indicia (bar coding, for example) as well as human-readable indicia to make it easier for a player to relate to. Alternatively, the player may simply be told an ID number, or may be told nothing. In the last case, the database will simply receive the ball ID data from the reader and store the IDs as a group. When data regarding one ball arrives at the database, it is stored in fields associated with the ball and thereby with the group of balls. This last solution is workable in smaller ranges with small numbers of players, but is not the preferred method of associating balls with players in larger installations nor for multi-site installations.

The result of any of these ball ID data storage methods is that there will be a set of ball IDs associated into a group, with a preferred embodiment further associated the balls with a player ID (either a temporary or permanent ID). This initial reader is shown generally as reader 112 in FIG. 1, where it reads the balls and sends the ball data (in whatever manner it is operably communicating, hardwired port, networked, RF, IR, etc.) to Server 104. Reader 112 is shown as having two sections, which represents two local readers. The other reader is at the tee area, reading balls as they are hit. The reader in the tee area may further include a time stamp when the ball passes a certain point. This reader may be an RFID reader, or may be another type of sensor (perhaps using an infrared interrupt across the play area, but any similar detection method will work).

In this particular embodiment, the player database is shown on server 100, which is separate from server 104. In smaller establishments this will typically be the same physical computer. However, for larger establishments spread over a wide physical area (or having multiple sites), there will be local servers such as server 104 which will relay the data to a central database 102 on central server 100, which may also be (in one embodiment) a WWW server. Connection 106 is any operable connection, which includes any type of LAN or WAN, including (although not preferred) a session-based dial-up type connection.

Cashier stations 110 will be connected to the local server in a direct manner (LAN, direct ports, wireless RF), or through the WWW to central server 100. They are enabled such that any paying actions are relayed to the station by the server to which it is connected. Paying actions include, but are not limited to, ball purchases, tee fees, or payouts from making a predetermined amount of points on the targets (if the range is set up to associate points with specified target receivers, which is expected to be typical).

Server 100 also enables players to reach the server from a home machine via the WWW, which will show them either their own player account, or will show the results of any ongoing tournaments associated with hitting the targets. Also shown operably connected to server 100 is one player-visible display (such as a large programmable lit sing, such as are used in baseball parks) 114. Another such display is shown as 116. These displays are used when the range is having betting games, to inform players of the current value of a pool or prize amount that may be won upon the player meeting a certain skill level (i.e., hitting or throwing 6 balls into a specific target in a row).

FIG. 1 was primarily described as a golf range system. However, the same system architecture will work with other ball based ranges, where "ranges" is used to mean any place where a person may use a ball in some manner, directing it towards a target. For example, a baseball range would have automatic throwing machines and hitting areas (similar to batting cages, except the front portion of the "cage" faces an area having at least one target) and a set of balls a person threw at targets; a basket ball range would have one or more targets that would simulate basket shooting and accuracy of passing; and, a football range would have targets designed to be thrown at or kicked at, or both.

Figure 2:
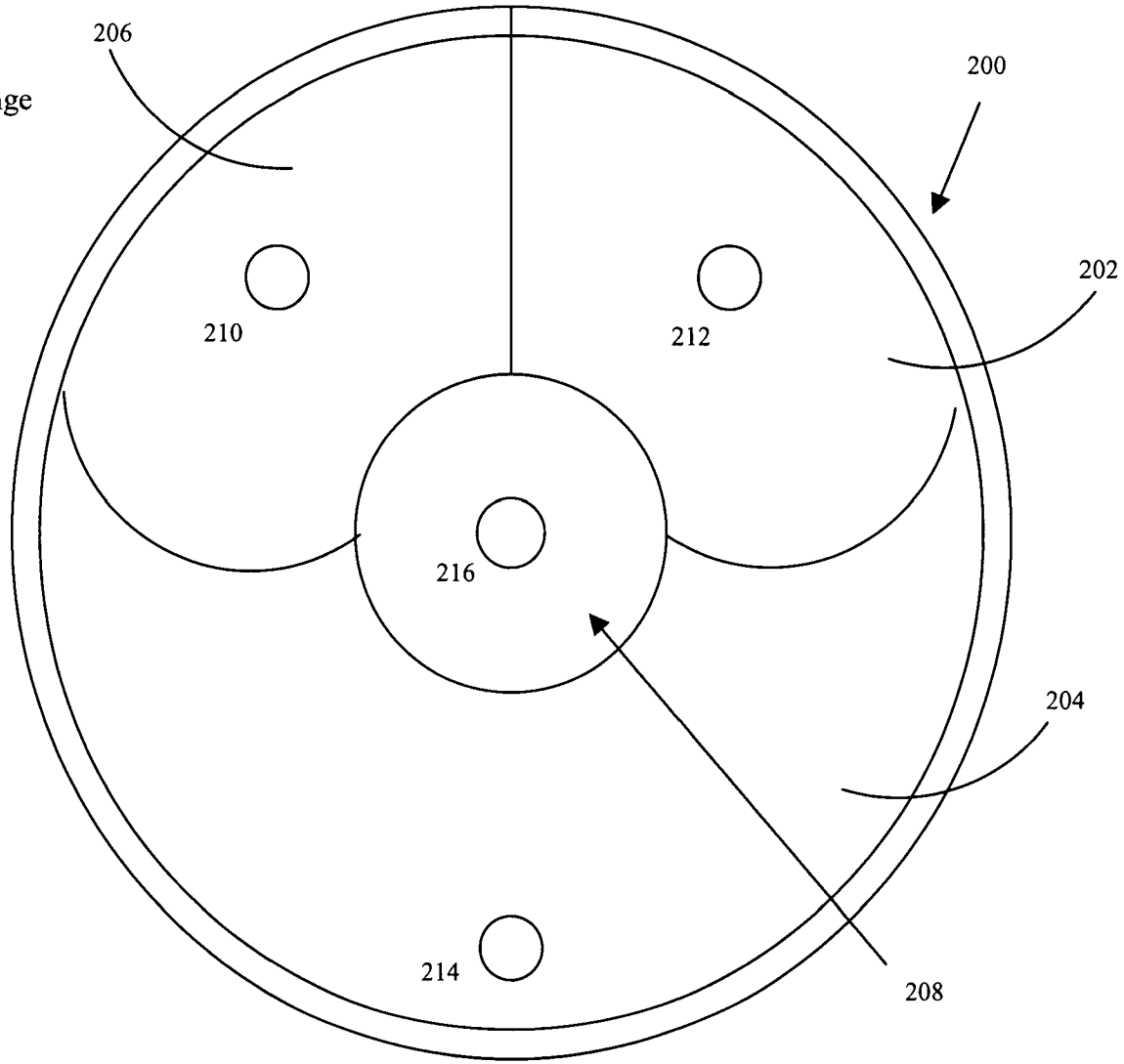
FIG. 2 is a top view a target in accordance with the present invention.

FIG. 2 shows a top view of one embodiment of a portable target. The target top 200 has four areas, area 202, area 204, area 206, and central area 208. Each of these areas defines a location such that if a ball lands anywhere within the area, it will roll to a receptacle in that area. For example, if a ball lands anywhere in area 208, it will roll into receptacle 216. Area 206 has receptacle 210, 202 has receptacle 212, and 204 has receptacle 214. Each area will typically be have different point values (scoring values) associating with it. In this case, area 208 has the highest value and area 204 (the "catch-all" area) has the lowest. The ball, upon entering any of the receptacles, will have its RFID read by an RFID reader placed inside the receptacle.

A novel and superior reader configuration is the preferred embodiment inside the receptacles, where the reader coils are wrapped around the tube in which the ball rolls. This allows faster, more accurate signal pickup than having the reader coils beside and outside the area in which the ball rolls, although for some less expensive implementations the prior-art style external readers may be used.

Figure 3:
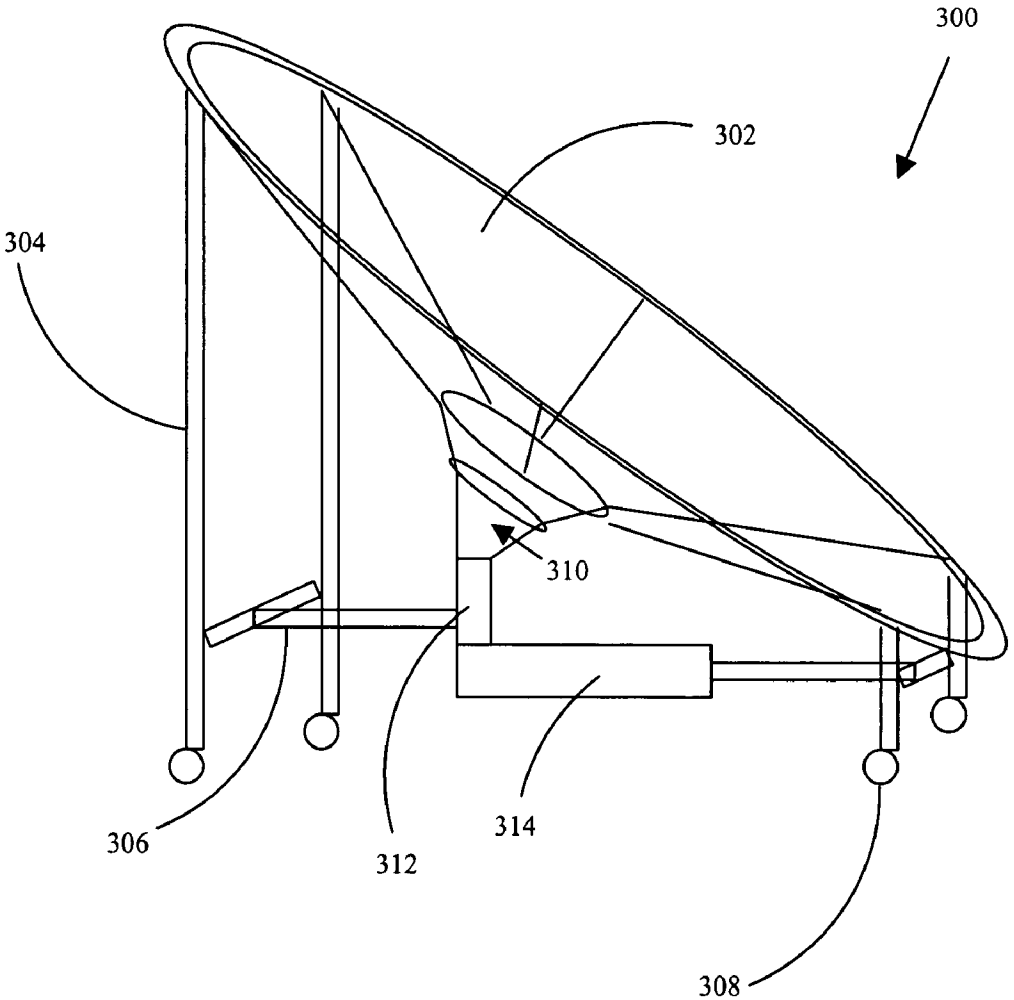
FIG. 3 is a perspective view of a target in accordance with the present invention.
Figure 3:
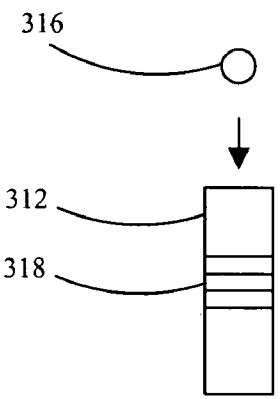

FIG. 3 shows a perspective view of a target according to the present invention. The entire target, 300, is movable. There is a central net area 302 which guides a ball landing within it to receiver or receptacle (both names refer to the same component) 310. Receiver 310 guides the ball into reader/transmitter 312. In one embodiment, reader/transmitter 312 includes a GPS receiver as well as a reader for the golf balls. However, the GPS receiver may be in a separate physical unit on the target unit if so desired, or, for some installations will not be included at all. As is known about GPs receivers, a GPS receiver receives signals from GPS satellites and, from the signals, determines its location (latitude, longitude, altitude) within a few feet (the accuracy will depend on the receiver).

Upon receiving and reading a golf ball, reader/transmitter 312 further takes a readout from the GPS receiver (if a GPS reader is present). The data is now sent to the closest server, as was shown in FIG. 1. This data may further include time, or, the time may be attached by the server upon receipt of the data. The balls are then collected in collector 314, to be retrieved by range personnel. Note that reader/transmitter 312 and collector 314 are attached via supports 306 to target support legs 304. The attachment may of any type that allows the unit top be moved as a whole. Further shown are caster wheels 308, allowing the entire target to be rolled. Note, however, that the concept of "mobility" as used herein does not require wheeled mobility. For example, in larger ranges it may be preferable to have the legs 304 be flat on the bottom, and the entire unit is picked up using a lull with tangs, a fork lift, or similar mechanical lifting mechanism. Further, reader/transmitter 312 and collector 314 could be designed to sit on the ground. In such cases the target, when moved, would be moved in two (or more) pieces; the top target mesh or net (which can be made very light, and movable by 2 to 4 people), and the receiver/reader/transmitter/collector, which may be heavier than the top target portion, but movable when separated from the rest of the target. It would then be placed under the target top in the target's new position, and operably connected to receiver 310 (310 may have be a flexible connector to enable easy connections, for example).

The key property to being mobile is that it is not permanently installed in one location. This is direct contrast to permanent target installations which may be found in the UK, where there are golf ranges that have what appear to be skee-ball-like targets permanently installed in the middle of some golf range. These permanent targets are made of concrete and their associated drains or ball receivers are permanently installed underground in the range.

Mobility for smaller target units means they can be moved as a single assembled piece by several people without much difficulty; mobility for larger target units (used at larger ranges) may require separation into smaller subcomponents, moved as pieces, and then reassembled at the new location. It is expected that for larger targets, the target top would be one piece, the multiple ball receivers and reader/transmitters associated with each ball receiver would be another set of separable components, and the supporting legs be a third set of separable components. For larger targets with multiple ball receivers, a preferred embodiment will have a GPS receiver as part of each reader/transmitter.

Also shown in FIG. 3 is a close-up of reader/transmitter 312. Golf ball 316 enters through the entry portion of the central guide tube of 312, passing through a set of coils 318 that the reader energizes and uses to energize the RFID tag inside the golf ball 312, the RFID tag returning a unique ID (a unique number identifying each particular golf ball, creating a one-to-one mapping between each golf ball and a unique ID number), the golf ball then exits the reader via the exit end of the guide tube. The central portion, shown here as a tube used to guide a golf ball, need not be a tube—other embodiments include a simple inclined ramp that guides the ball past a standard RFID reader to one side of the ball. Shown is a preferred embodiment of the reader, where the antennae coil is wrapped 318 around the guide tube portion of reader/transmitter 312. This enables faster reading with less directional dependency of the ball.

The description given for the mobile target is a new target for use in any type of range, although it was discussed as used in a golf range. Substantially the same target (with a larger opening to receive the ball) can be used for soccer balls, baseballs, or basketballs. Further, the system shown in FIG. 1 may include traditional stationary targets (not shown) in addition to mobile targets. It is expected that most ball ranges will have a combination of both stationary and mobile targets.

Figure 4:
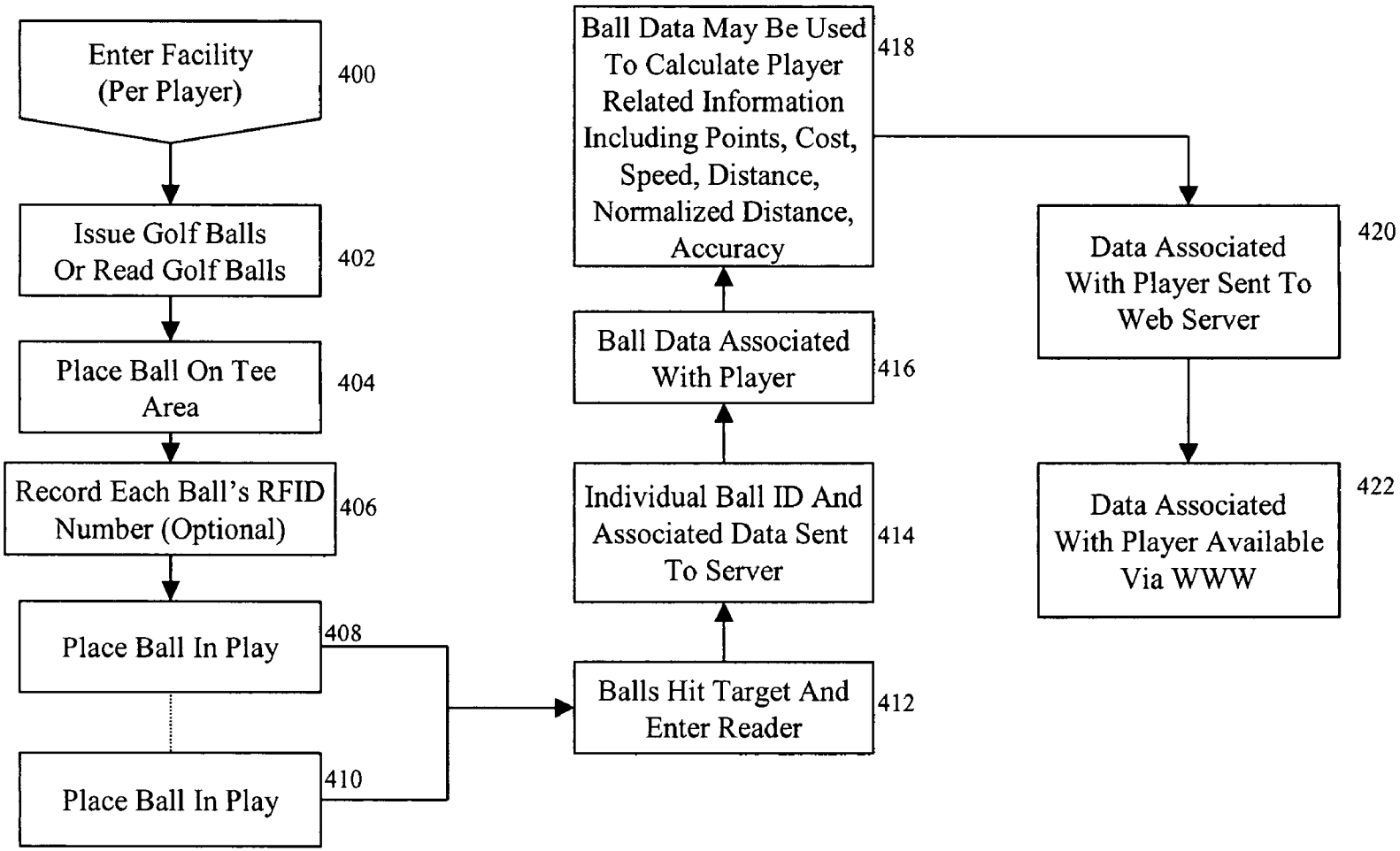
FIG. 4 is a flow diagram showing a method of using a golfing system in accordance with the present invention.

FIG. 4 shows one method of use of the present invention. The example illustrated is for a golf range, but the same flow would apply to baseball, basketball, and similar ranges; such other ball type ranges are understood to be included herein. Staring at entry point 400, a player enters the golf range (ball facilities). At this point in the flow diagram, the actions correspond to a single player. However, these actions will be repeated for all players.

Entry point 400 is left and block 402 entered. The actions corresponding to block 402 are those involved with reading the IDs of the balls that the player will use for this golf session, and saving the ball ID information in a retrievable manner in a database. If a player has no player ID, or the range does not use player IDs, then one of two things happens. The ball IDs are read and entered into a database associated with a temporary player ID, or in a manner such that the ball IDs are designated and can be referenced as a temporary group (i.e., using a "group ID field"). Block 402 is left and block 404 entered.

The actions corresponding to block 404 are those associated with playing each ball of the group just read. For a golf range, play consists of placing a ball on a tee area (matt, driving area, etc.), and hitting it (baseballs may be thrown or hit, basketballs are throw, etc.). There may be one of several consequences to this action by the player; the consequences will depend on the range. In upper-end ranges, the ball ID will be read at the origination area (tee are for golfing). This enables tracking and timing information to be calculated, if so desired. The ball will trip a sensor upon being hit which sends timing data (or, sends a signal for a server to record its own time and associate it with the hit event, depending on the operable connection between a local server and the tee area). This will later be combined with the data from the target and used to determine average speed, etc. Sensors may span the range from an RFID reader in the tee area to a beam-interrupt type sensor just in front of the tee area. Alternatively, there may be no sensors in this area in smaller ranges with less expensive infrastructure, or if there is no desire to calculate data such as speed. It is expected that many installation will use ball data from the targets, and will forego taking sensor readings where the ball is launched. In one embodiment, there will be a GPS receiver reading corresponding to the tee area (or, a plurality of tee areas) stored in a known retrievable location on at least one server to enabled distance calculations, even when there are no active sensors in the tee area. The ball is now in play (on its way down the range), so block 406 is left and block 408 is entered.

Blocks 408 and 410 correspond to balls in play originating from any and all players currently on the range. There may be any number of equivalent blocks between 408 and 410 feeding block 412, as shown by the dotted lines between blocks 408 and 410. All those blocks feed into block 412. Block 412 is now entered.

The actions corresponding to block 412 are the balls hitting someplace on the target surface and entering at least one receiver (some targets may have only one receiver, others may have many). As each ball enters a receiver, its ID is read by the receiver. Leaving block 412 and entering block 414, the receiver then transmits the ball ID and any related data a range desires (i.e., GPS position, time the ball went through the receiver, etc.) to a local server. Block 414 is left and block 416 entered.

The actions corresponding to block 416 take place in the server. The data sent by the receiver is associated with a player (if a player ID is used), or, is associated with a "ball group" if no player ID is used. If the server is a local server and there is a central server, that data may then be relayed (a copy sent to) a central server. Note that it is not necessary to send a copy of the data (in toto) to a central server; each installation will decide what data is needed at the local level and what is needed at the central level, and the data will be forwarded accordingly. Block 416 is left and block 418 is entered.

The actions corresponding to block 418 are to take any and all data associated with this ball ID and player ID (if any), store the information, and make calculations and/or target-hit indicators. At a minimum this includes the target hit and the ball ID. If there is a player ID and if there were sensors at the tee area, that data is also available for use in calculate.

The calculations and data are then used to determine any point or prize value for the target/receiver that was hit for game or gambling use. Other calculations may include target distance (the distance the ball traveled, using the GPS data if any), and costs associated with the play (for example, rather than buying a bucket of balls, this system allows a player to be charged on a per target hit basis, which has advantages to both the player and the range). If there are sensors in the tee area, an average ball speed could be calculated. Additional calculations could be a normalized distance calculation (possible because the altitude is known, allowing for the air density to be compensated for in a normalized distance calculation—very helpful for comparing driving results on different golf courses) and an accuracy calculation (if the targets being hit are similar to that shown in FIG. 2, where the center is the best target result). These calculations are then stored with the player ID and other data, or the ball group data. Box 418 is completed. The actions just described may be carried out locally, at a central server, or in some cases will be partially done by both. The process may end here or, in embodiments having a WWW server, box 420 is entered.

The actions corresponding to box 420 include incorporating the data into the database used by the WWW server, enabling the results to be shown on the web. Note that in many cases, the physical implementation will be such that the same physical computer is used for all the actions in FIG. 4. Box 420 is left and box 422 is entered. The actions corresponding to box 422 are to make the results (all the data collected and stored) available to people who log into the WWW server available on the web. This may be on an individual basis, where a player retrieves only her or his own data, or may display the results of ongoing tournament, points competition, promotional play, and general gaming play based on target hits as well as other results desired to be displayed by the range.

Figure 5:
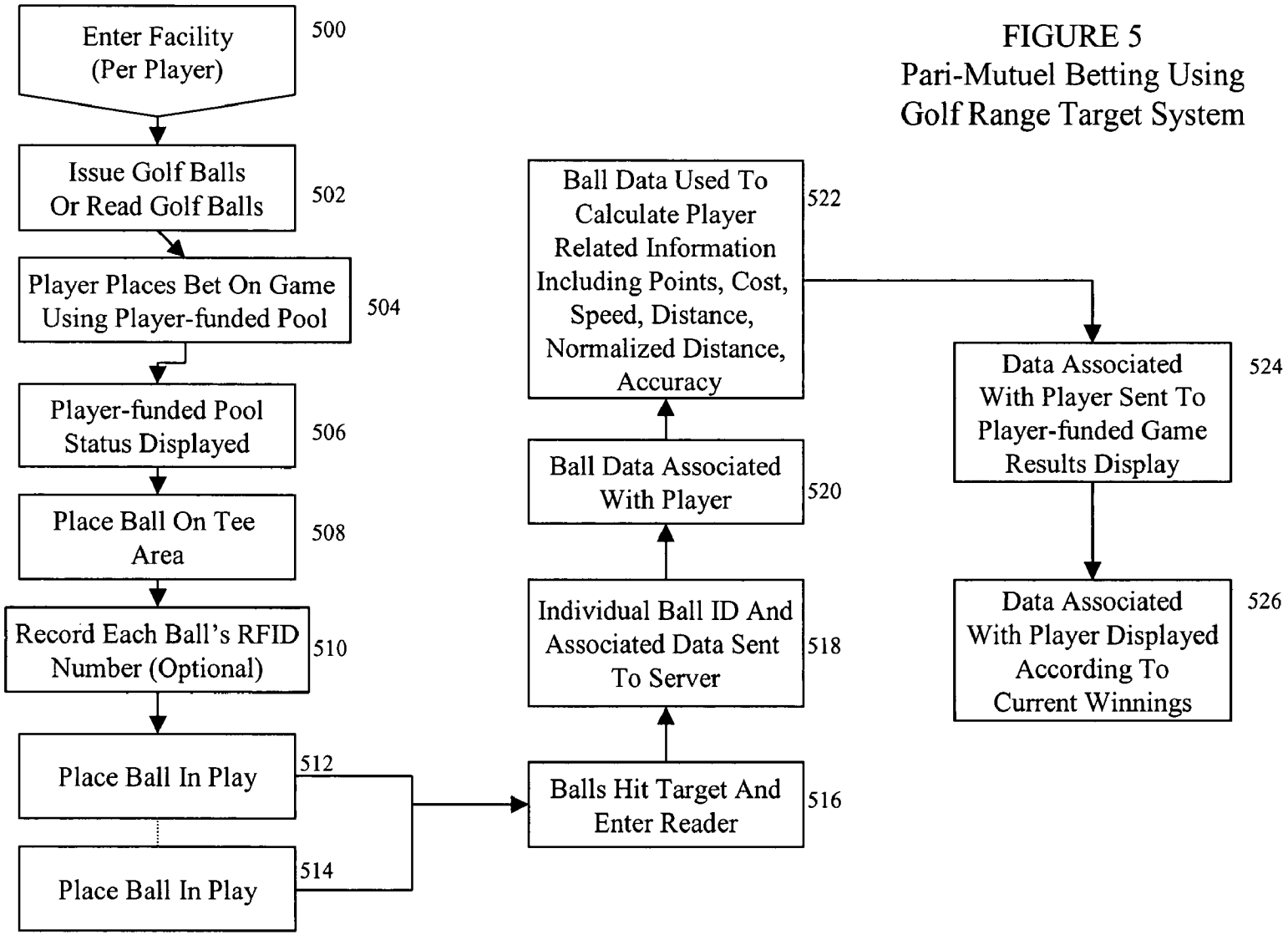
FIG. 5 is a flow diagram showing a method of using a golfing system including player-funded betting in accordance with the present invention.

FIG. 5 shows one method of using the present invention for pari-mutuel style betting, progressive style betting, and other game-play-based betting games where the players participating in the betting fund the pool. As with FIG. 4, the example illustrated is for a golf range but the same flow would apply to baseball, basketball, and similar ranges; such other ball type ranges are understood to be included herein. Staring at entry point 500, a player enters the golf range (generically, ball range). At this point in the flow diagram, the actions correspond to a single player. However, these actions will be repeated for all players.

Entry block 500 is left and block 502 entered. The actions corresponding to block 502 are those involved with reading the IDs of the balls that the player will use for this golf session, and saving the ball ID information in a retrievable manner in a database. As explained previously, the ball IDs may be read and entered into a database associated with a temporary player ID, in a manner such that the ball IDs are designated and can be referenced as a temporary group (i.e., using a "group ID field"), or associated with a permanent player ID. Block 502 is left and block 504 entered.

The actions corresponding to block 504 are those associated with a player making a bet in any game being played at the ball range where the winnings are player funded. "Player funded winnings" and "player funded pools" includes any game where the amount won by a player comes out of a pool of money that has been generated by other player's bets (betting activity). It does not include traditional casino style betting, where each player is betting against the house. The classical example of a player-funded pool is pari-mutuel betting at a horse race. A typical definition of pari-mutuel betting follows.

A system of betting on races whereby the winners divide the total amount bet, after deducting management expenses and/or management profit (typically a percentage of the amount bet), in proportion to the sums they have wagered individually.

This is an example of player-funded betting, in that the players' funds are used to make up the overall pool to be split after the race is finished. This style of betting, previously much too logistically difficult to use in ranges, can now be used with ball-based games with the targets and system of the present invention. One example would be to run a "pari-mutuel target game" that entails having a plurality of targets on the range, players buying a relatively small number of balls (i.e., 6), where at the time of purchase players bet on their ability to hit a designated target 6 times, with different targets having different weights (typically distance dependent), and then hitting the six balls on the range. The overall game play (players participating in this pari-mutuel pool) would have to buy and play their balls between 8 AM and 9 AM Saturday, with a new pari-mutuel pool being run each hour until closing. If the player hits the target they bet they would hit, at the end of the time for the pool in which they are participating the players who won would divide up the pari-mutuel pool, the division being weighted by the target chosen and the amount each player bet.

Another example of player-funding is the progressive pools found at many casinos, often called a progressive jackpot. This is a jackpot that is won (in a casino) upon the occurrence of a specified random event, with the money in the pool generated by taking a percentage of each player's play at a designated set of gaming machines. A further example of a player-funded pool are the state-run lotteries throughout the US.

An example of a player-funded game usable with the present invention and using a progressive style player funding pool (called "progressive funding" or "progressive pool" hereinafter) is:

(i) take a fixed percentage of each players' ball purchases and put it into a winnings pool (a player funded pool);

(ii) designate a specified event as a winning event (i.e., 10 consecutive balls from a single player into a specified target within a specified amount of time, with balls purchased 10 at a time; 1 ball in each of five targets, with the balls being purchased 5 at a time, etc.);

(iii) have no specific time limit for the overall game, that is, the pool continues to grow until a player, using skill, hits the required targets with the required balls (a winning event occurs); and, (iv) start the pool again as soon as a player wins the existing pool, thus keeping the game going indefinitely.

The key elements that make up a progressive pool are the funding of at least one pool in a game using targets on which a player can place bets a percentage of each player's bet, then using that percentage to fund the pools associated with the game (there may be more than one pool associated with a game), coupled with a game that defines winning events that a skilled player may eventually reach, where there is at least one pool that continues to grow as game participation continues and, upon the occurrence of a winning event, the designated pool is awarded.

The present invention makes this type of player-funded game particularly easy to administer, including being played over multiple physical sites. Using an RFID reader at the tee area as well as in the target, the system would simply note each time a player hit a ball and which target the ball landed in. If the player hits the designated number of balls in the designated amount of time into the designated target(s), the player wins. This would all require no additional work on the part of the range management and its personnel, other than programming into the system the conditions that define a win.

Note that if a ball misses a target altogether, the system can handle that by designating a "time out" period, that is, a period of time after which the ball can reasonably assumed to be on the range but not in a target. It will be designated as a "miss". If the stakes of the game are high enough that a player challenges the designated miss, a physical check can readily take care of issue. Either the range can make use of security-style taping mechanisms and perform a visual tape check of the questioned ball, or the balls on the ground can be picked up and run through the present invention's RFID reader. If the players' contested ball is amongst those picked up by the ball sweep, it was a miss. It is assumed that for ranges where the winning pool builds to such an amount as to encourage active cheating, the range will employ standard security measures such as tape recordings of players and their balls on the range. Typically, the need to resort to such measures would be rare.

Continuing on with FIG. 5, block 504 is left and block 506 entered. The actions corresponding to block 506 are to update a display that is visible to players at each location where players may enter the same player-funded game, showing a total winning amount, or, showing odds changes if the game is being run in a traditional pari-mutuel manner. It is anticipated that many sites will be running player-funded pool games that encompass both pari-mutuel style games and progressively building jackpot style games, in which case the displays shown as 114 and 116 in FIG. 1 would be implemented with portions of the screens devoted to each game, or with physically multiple screens at each site where each screen displays a subset of the games currently active at the site.

It is expected that there will be many games running simultaneously at each site, with all or a subset of those games being played at multiple sites. Games played on multiple sites enables the pool for those games to grow larger and faster than the single-site games. Any combination of single-site games and multiple-site games is within the inventive concepts described herein.

Continuing from block 506 to block 508, the player places a ball in the tee area. Block 510 is now entered. Some sites may have an RFID reader at the tee area that reads the ball, where other sites may have no sensor or may have a lower-cost interrupt style sensor. For sites with sensors, the sensor data is communicated back to the local server; sites with no sensors at this location will not send data to a server at this time.

Continuing into block 512, the player places the ball into play (hits it, throws it, kicks it, or otherwise propels it forward using the appropriate method for the actual ball game being played, in general called the ball launch, and where this is done is called the ball launch area, in this example a tee area where a golf ball is hit). Similarly to FIG. 4, blocks 512 and 514 indicate any number of players may be placing their balls into play at this time. Block 516 corresponds to the balls continuing down range, hitting a target, and traveling through an RFID reader. Block 518 corresponds to the data just collected on the ball that just went through the reader (from the RFID reader and optionally a GPS reader) to a server, usually a local server (it may be the only server in smaller systems). Block 520 corresponds to actions taken within the server and networking system of the particular installation. The data that has been sent from the reader is communicated to a database running on the local server, and if applicable a central server. The data is associated with a ball that is further identified with a player ID (either an identified player or an anonymous player ID), or simply with a group of balls. Note that if the ball identification data does not correspond to any established group, it would indicate an error of some kind, typically because the ball was never scanned at the range before being put into play.

Continuing on to block 522, the data just entered into the database is now used to make any calculations needed for any current games being played at the range. For example, if a pari-mutuel style wagering game consisting of buying 10 balls and hitting 8, 9, or 10 designated targets were in play, the application program would check the status of all the balls in the group of 10 for which the data just came in, and if (i) all ten balls have an entry in a target-field (containing either the target hit or a miss indicator) and if (ii) those balls that hit a target form one of the winning sets (one of the sets on which a player could make a bet), that combination is compared to what the player did bet. Continuing into block 524, the results of the check are provided to the player in accordance with system installation at that range (shown is an exemplar using the common, large display visible to all users).

In the case where the range has RFID readers at the tee area, there could be a small LCD screen discretely placed next to the tee area (not illustrated) and driven using direct lines from a local server. The LCD would display "game start", "game end", and after "game end" what, if anything, was matched. The final amount won could not be calculated until the pari-mutuel game play was over. The results could also be displayed on the larger screen visible to all players, using an ID number or a name for identified player IDs. Otherwise, a player would go to a kiosk or service desk and get their results. All these methods would involve the display of the information from either a local server or a central server, with the display means operatively connected to the server (LAN, RF interface, serial port, etc.).

Finally, block 526 corresponds to actions taken to show (and, if applicable, award) a player their final winnings or earnings. As discussed above, there are several means by which a participating player can be presented with the final winnings. It can be the same display that is visible to all players on a range; it can be a small LCD display at a tee area, it could be a display at a kiosk (not illustrated) which contains one or a plurality of screens that are roughly TV sized, and either displays all current players' winnings (perhaps scrolling slowly through, if there are too many player IDs or player names for one screen) or allows a player to log into the central server's WWW interface and call up there own data. A player may also go to an attendant's booth to look up any winnings, and to be paid. The present invention contemplates a pay-out input/output device (visual display with a cashiers' drawer) be installed in at least one attendant's booth, allowing a player to cash-out any winnings. Although other methods could be used (i.e., sending the winnings to a player by check), to create and maintain player interest and excitement it is preferable to make cash pay-outs on the range.

In the case where the player-funded pool corresponds to a game that is a steadily-growing jackpot (rather than traditional pari-mutuel), as soon as the winning event occurs the player would be notified and paid, and the player-visible displays would show that game as having a jackpot won, and re-set the pool to $0. Alternatively, the percentage contribution made by players could be split into two pools, one foreground pool (what is shown on the player visible display) and one background pool. The background pool is funded up to the point of reaching a desirable minimum jackpot amount, then all further player contributions go into the foreground pool. When a player wins, they win the foreground pool amount. But, the amount available as the next jackpot does not start at $0, it starts at the level of the background pool, which is now made the foreground pool. As players continue to play, both pools are built up until the background pool reaches its pre-determined level. Then, once again, all contributions go to the foreground pool. This prevents the jackpot from being $0, which is not very enticing to players.

The present invention has been partially described using a flow diagram. As will be understood by a person of ordinary skill in the art and with the benefit of the present disclosure, steps described in the flow diagram can vary as to order, content, allocation of resources between steps, times repeated, and similar variations while staying fully within the inventive concepts disclosed herein.

Accordingly, it will be seen that this invention provides a system and method for providing novel and useful real-time and on-line player feedback and excitement at a golf range. Although the description above contains certain specificity, the described embodiments should not be construed indicating the scope of the invention; the descriptions given are providing an illustration of certain preferred embodiments of the invention. The scope of this invention is determined by the appended claims and their legal equivalents.

What is claimed is:

1. A player-funded ball-based gaming system comprising:

a target having a top surface and at least one portion of said top surface having at least one opening in operable connection to a target reader/transmitter, said target reader/transmitter further comprising an entry portion, a guide portion, and an exit portion, a first RFID reader configured such that a ball, upon entering said entry portion, will follow said guide portion past said first RFID reader in a readable manner and then exit via said exit portion, and where said target reader/transmitter is operable for communication with at least one server;

a second RFID reader configured to read a ball RFID tag enclosed in a ball before said ball reaches said top surface, and extract ball IDs thereby and further configured to be in operable communications with at least one server;

a site server operable for communication with said at least one target reader/transmitter and said second RFID reader and configured to make at least one calculation regarding ball data using data received by said site server from at least one of: said target reader/transmitter; or, said second RFID reader, said site server further comprising a database and a program configured to enable play of at least one game comprising a player-funded progressive system, said progressive system comprising a system to determine and distribute winnings from a pool to a plurality of players comprising differing bet amounts for a game configured to be player-funded by pooling a portion of said bet amounts collected as part of enabling RFID-equipped balls for game play;

said database configured to retrievably hold ball IDs in associated with one of: other ball IDs; or, at least one player ID, and further configured to hold data sent by said target reader/transmitter and said second RFID reader, and store said calculated ball data, in a manner retrievable by one of: a player ID; or, a ball ID;

a cashier station configured to be in communication with said site server and a central server, said cashier station further configured to receive and process a plurality of paying actions, said paying actions comprising ball purchased, tee fees, and payouts for said at least one game; and a WWW server configured to be in communication with said site server, said cashier station and said central server, enabled to allow logged in users to retrieve a plurality of information comprising individual player account data, a plurality of results of ongoing tournaments.

2. The system of claim 1 where said first RFID reader is configured such that its antenna coils are wrapped in a tubular manner around said central guide.

3. The system of claim 1 where said second RFID reader is configured such that its antenna coils are wrapped in a tubular manner around a guide, said guide configured to enable a ball to pass through said tubular antenna coils.

4. The system of claim 1 further comprising a sensor located near at least one ball launch area, said sensor configured to detect a ball that is one of: placed on the ball launch area; hit from the ball launch area; or, both placed on, and hit from, the ball-launch area; and is further configured to transmit data about said detected ball to a server.

5. The system of claim 1 further comprising a plurality of servers, where said plurality of servers are in operable communication with each other, and where one of said plurality of servers further comprises a database, said database configured for player accounts, and further configured to hold one of: target data, ball ID data, detected ball data; or, target data and ball ID data and detected ball data in a manner associated with a player account.

6. The system of claim 1 further comprising a plurality of servers, where said plurality of servers are in operable communication with each other, and where one of said plurality of servers further comprises a database, said database configured for storing data in a manner retrievable using ball IDs, and further configured to hold one of: target data, a plurality of ball IDs, detected ball data; or, target data and ball ID data and detected ball data in a manner associated with a ball ID.

7. The system of claim 1 where said target, said first RFID reader, and said second RFID reader are configured to read one of: a golf ball; a basketball; a baseball; or, a football.

8. The system of claim 1 where said at least one target further comprises at least one mobile target having at least one of said target reader/transmitter.

9. The system of claim 1 where said progressive system comprises a plurality of sites.

10. A method of using a ball range system, the ball range system having at least one target, the target having an RFID reader in communication with a plurality of servers, said plurality of servers comprising at least one server having a database and further having a program configured to use said database to enable a player to play at least one game comprising a player-funded progressive system, the method comprising:

configuring said progressive system to determine and distribute winnings from a pool to a plurality of players comprising differing bet amounts for a game;

configuring said progressive system to be player-funded by pooling a portion of funds collected as part of enabling RFID-equipped balls for game play;

providing a set of balls having RFIDs therein, where said set of balls comprises at least one ball;

storing said set of ball IDs on said database, said ball Ids comprising RFIDs and global positioning system (GPS) information;

associating said set of ball IDs with an account on said database;

allowing said set of balls to be launched from a ball launch area towards at least one target having at least one ball receptacle attached thereto, said at least one target configured to be moveable;

gathering data on any hits on any target by said launched balls;

sending said hit data to said server and retrievably storing it associated with a player ID;

communicating information from said server and said database to a cashier station configured to be in communication with said plurality of servers;

enabling said cashier station to access and process a plurality of paying actions composing ball purchases, tee fees, and payouts of said at least one game; and enabling a person having access to said account to retrieve data about said ball hits and any other data collected pursuant to using said set of balls.

11. The method of claim 10 where said providing a set of balls is a set of purchased for play by a player at said cashier station.

12. The method of claim 10 where said providing a set of balls is a set of balls owned by a player, and brought to the range by said player.

13. The method of claim 10 where said associating said set of ball IDs with an account further comprises associating said set of ball IDs with a specific player account.

14. The method of claim 10 where said associating said set of ball IDs with an account further comprises associating said set of ball IDs with an anonymous player account.

15. The method of claim 10 where said associating said set of ball IDs with an account further comprises associating said set of ball IDs into a group, said group being accessible using any one of the ball IDs contained in the group and providing for team-based play of said at least one game.

16. The method of claim 10 where said gathering data on any hits on any target further comprises:

providing a plurality of targets;

recording data on any ball from said set of balls that reaches any target;

sending said gathered data to a site server;

gathering all sent data in said database;

providing said data to any authorized user, player, or program running on said server and said cashier station.

17. The method of claim 10 where said target, said target RFID reader, and said range entry RFID reader are configured to read one of: a golf ball; a basketball; a baseball; or, a football.

18. The method of claim 10 where said said progressive system comprises a plurality of sites.

19. A method of wagering using a ball range having a ball range system, the ball range system having at least one target, the target having an RFID reader in communication with a plurality of servers, said plurality of servers comprising a server having a database and further having a program configured to use said database to enable a player to play at least one game comprising a player-funded progressive system, the method comprising:

configuring said progressive system to determine and distribute winnings from a pool to a plurality of players comprising differing bet amounts for a game;

player-funding said progressive system comprising pooling a portion of funds collected as part of enabling RFID-equipped balls for game play;

reading a set of balls at a range entry golf ball RFID reader;

associating a player with said set of balls;

accepting payment from a player for a wager, said wager based on using said set of balls;

allowing said player to go to a ball-launch area;

recording in said database output from a sensor located in said ball-launch area each time a ball is placed in said ball-launch area;

recording each ball from said set of balls that hits a target; and, determining if said set of balls have been played and if said set of balls that hit a target comprise a winning event, said target having at least one ball receptacle;

communicating information from said server and said database to a cashier station configured to be in communication with said plurality of servers; and enabling said cashier station to access and process a plurality of paying actions comprising ball purchases, tee fees, and payouts of said at least one game.

20. The method of claim 19 where said associating a player with said set of balls further comprises associating a player ID with said set of balls.

21. The method of claim 19 where said associating a player with said set of balls further comprises associating an anonymous player ID with said set of balls.

22. The method of claim 19 where said target, said target RFID reader, and said range entry RFID reader are configured to read one of: a golf ball; a basketball; a baseball; or, a football.

23. The method of claim 19 where said at least one target further comprises at least one mobile target.

24. The method of claim 19 where said progressive system comprises a plurality of sites.

25. A method of creating enhanced player interest at a ball range having a ball range system, the ball range system having at least one moveable target, the target having an RFID reader in communication with a server and at least one ball receptacle attached thereto, the server having a database further having a program configured to use said database to enable a player to play at least one game having at least one player-funded progressive system, the method comprising:

configuring said progressive system to determine and distribute winnings from a pool to a plurality of players comprising differing bet amounts for a game;

configuring said progressive system to allow enablement of player-funding by pooling a portion of funds collected as part of enabling RFID-equipped balls for game play;

displaying games and associated player-funded pool amounts in a manner visible to a player;

updating said player-funded pool amounts as said games are being played by players;

displaying amounts won by players upon the occurrence of game winning events;

communicating information from said server and said database to a cashier station configured to be in communication with said plurality of servers; and enabling said cashier station to access and process a plurality of paving actions comprising ball purchases, tee fees, and payouts of said at least one game.

26. The method of claim 25 where said target, said target RFID reader, and said range entry RFID reader are configured to read one of: a golf ball; a basketball; a baseball; or, a football.

27. The method of claim 25 where said at least one target further comprises at least one mobile target.

28. The method of claim 25 where said progressive system comprises a plurality of sites.

* * * * *